US006950019B2

(12) United States Patent
Bellone et al.

(10) Patent No.: US 6,950,019 B2
(45) Date of Patent: Sep. 27, 2005

(54) MULTIPLE-TRIGGERING ALARM SYSTEM BY TRANSMITTERS AND PORTABLE RECEIVER-BUZZER

(76) Inventors: Raymond Bellone, 26, Premiere Avenue, Lamorlaye (FR), F-60260; Alexia Bellone, 26, Premiere Avenue, Lamorlaye (FR), F-60260

( * ) Notice: Subject to any disclaimer, the term of this patent is extended or adjusted under 35 U.S.C. 154(b) by 32 days.

(21) Appl. No.: 10/433,665

(22) PCT Filed: Dec. 7, 2000

(86) PCT No.: PCT/FR00/03434

§ 371 (c)(1),
(2), (4) Date: Nov. 20, 2003

(87) PCT Pub. No.: WO02/47045

PCT Pub. Date: Jun. 13, 2002

(65) Prior Publication Data

US 2004/0169584 A1 Sep. 2, 2004

(51) Int. Cl.[7] ..... G08B 1/08

(52) U.S. Cl. ..... 340/539.11; 340/573.1; 340/7.6; 340/407.1

(58) Field of Search ..... 340/573.1, 539.1, 340/539.11, 7.5, 7.6, 532, 541, 539.15, 407.1

(56) References Cited

U.S. PATENT DOCUMENTS 3,704,346 A * 11/1972 Smith et al. ..... 379/157
3,739,329 A * 6/1973 Lester ..... 367/6
3,973,200 A * 8/1976 Akerberg ..... 340/7.22
4,336,524 A * 6/1982 Levine ..... 340/7.53
4,365,238 A * 12/1982 Kollin ..... 340/521
4,413,158 A * 11/1983 Danford ..... 379/211.02
4,421,953 A 12/1983 Zielinski
4,853,674 A * 8/1989 Kiss ..... 340/407.1
5,375,161 A * 12/1994 Fuller et al. ..... 455/417
5,481,590 A * 1/1996 Grimes ..... 340/7.21
5,774,050 A * 6/1998 Kagi ..... 340/539.11
5,905,438 A * 5/1999 Weiss et al. ..... 340/636.1
6,094,140 A 7/2000 Parente
6,118,979 A 9/2000 Powell

* cited by examiner

*Primary Examiner*—Jeffery Hofsass
*Assistant Examiner*—Eric Blount
(74) *Attorney, Agent, or Firm*—Young & Thompson

(57) ABSTRACT

The invention concerns transmitters and a portable receiver-buzzer with programmable triggering, hand-, voice-/sound- and pulse-operated, for remotely warning one or several persons. The inventive device consists of a receiver-buzzer case (16), a presence-detecting (23), telephone jack (30), entrance door (36), central transmitter housing (13) transmitting a coded signal to the reciever (20) triggering the motor-buzzer (21) and light-emitting diode (19). In the central transmitter housing (13) there are a clock (1), a voice/sound sensor (4), an alarm push-button (2), a presence detector push-button (14), a LED sector (8), two battery-controlled LED's (6 and 7), a switch button (5) for clock (1) and voice/sound sensor (4), an acknowledgement button (9), an alarm LED (2), a housing (11) for charging the receiver (20) battery, a potentiometer (10). The inventive device consists of a receiver-buzzer (16) wherein are a battery (22), a watch (18), three LED's (17), a receiver (20) receiving the coded signals from the transmitter triggering the buzzer (21). The device, by virtue of its functions, is designed for remotely warning in case of need, emergency or danger, any person equipped with a portable receiver-buzzer.

14 Claims, 3 Drawing Sheets

RIGHT HAND VIEW

FRONT VIEW

TOP VIEW

FRONT VIEW

LEFT HAND VIEW

CROSS SECTION
ACCORDING TO A.A.

FRONT VIEW

FRONT VIEW

FRONT VIEW

MULTIPLE-TRIGGERING ALARM SYSTEM BY TRANSMITTERS AND PORTABLE RECEIVER-BUZZER

SUMMARY OF THE INVENTION

The object of this invention is a transmitter vibrating receiver device, which uses the signals sent out by the different transmitters (central, presence detector, telephone plug and front door) to activate the vibrator-motor in the vibrating-receiver box as well as a LED located on the outside of the vibrating-receiver box. This LED discreetly warns the wearer of a portable vibrating-receiver, at a distance, of the occurrence of an urgent situation or danger. At the present time, the existing devices are sound warning systems—which can be awkward in some situations or places—or visual (light flashes), which considerably limit movement and also require sustained, or even constant attention. The device, as defined by this invention, is a solution to these problems. This device, as defined by this invention, consists of a central transmitter box, a "presence detection" box, a telephone plug box, and a front door box (operating on a 220 VAG 50/60 Hz supply and if needed on a battery) as well as one or several portable vibrating receiver boxes.

The central transmitter box contains a battery (with an electroluminescent bicolor—LED—which indicates the state of charge of the battery). In the event of a power cut of the mains supply, this battery provides power for the system operate for several hours: a charger to charge up the battery in the central transmitter and to charge up the portable vibrating-receiver. The central transmitter box also contains a transmitter, which can send out a coded radio wave (programmable by an encoder with a switch). This signal activates or deactivates the presence detector(s).

The central transmitter has a range and maximum frequency that comply with the law. This transmitter triggers the vibrator-motor in the portable vibrating-receiver box as well as the red LED that is located on the outside of the portable vibrating-receiver box. Four different possible ways of using the central transmitter box exist: The first way is to manually push on the "alarm" pushbutton, which triggers the signal sent out by the central transmitter to the portable vibrating-receiver that activates the vibrator-motor it contains, the red LED located on the portable vibrating-receiver box as well as a LED indicator on the central transmitter box indicating that the order sent out by the pushbutton "alarm" has been correctly transmitted and registered by the receiver; this indicator remains active until somebody presses on the "clearance" pushbutton located on the central transmitter box. The second way is by using a clock that can be programmed to trigger the signal from the central transmitter to the portable vibrating-receiver. This signal activates the vibrator-motor and the red LED located on the outside of the portable vibrating-receiver box. It is possible to program several cycles per day at different times and to program over an eight-day period. This clock synchronizes itself automatically whenever it encounters a transmission ray of DCF 77 radio signals. The third way is by using a voice/sound detector (voices, crying, noises) with a microphone and potentiometer for adjusting the frequency sensitivity. This sound detector triggers the signal in the central transmitter to the receiver in the portable vibrating-receiver box, which activates the vibrator-motor as well as the red LED located on the outside of the portable vibrating-receiver box. The fourth way is by using a pushbutton (lit up=active) to activate or deactivate the (unwanted intruder) presence detector(s). On the outside of the central transmitter box there is a manual reversing switch (cursor), which can be used to switch the order from the clock or the order from the voice/sound detector, or to connect or disconnect both of these. On the central transmitter box there is a housing with two golden and fool proofed contacts to receive the portable receiver-vibrator and charge up its battery, an antenna, a mains output with cord and protection, a green LED diode for the mains power supply, a potentiometer to adjust the voice/sound detector, a bicolor LED diode to indicate the state of charge of the portable vibrating receiver battery (red =discharged/green=charged). In the presence detector transmitter box there is a battery so that, in the event of a power cut of the mains supply, the system can continue to function for several hours. In the presence detector transmitter box there is a presence detector system, a receiver receiving a coded radio wave signal from the central transmitter that activates or deactivates the presence detection system as well as a transmitter which, once it is activated by the impulse from the presence detector, sends out a coded wave signal (programmable by a switch encoder—with a range and maximum frequency that comply with the law) to the receiver that triggers the vibrator-motor in the portable vibrating-receiver box as well as the three LEDs (red, yellow and green) located on the outside of the portable vibrating-receiver box. On the outside of the presence detector transmission box is the exterior part of the presence detection system, an antenna, a mains output, a light which is activated by the presence detector whenever a presence is detected, a red LED, which indicates that the presence detection system is activated as well as a green LED for the mains power supply. In the telephone plug transmitter box there is a battery so that, in the event of a power cut of the mains supply, to system can continue to function for several hours. In the telephone plug transmitter box there is also a transmitter which, once it is activated by the impulse from the telephone ring, sents out a coded wave signal (programmable by a switch encoder—with a range and maximum frequency that comply with the law) to the receiver that triggers the vibrator-motor in the portable vibrating-receiver box as well as a green LED located on the outside of the portable vibrating-receiver box. On the outside of the telephone plug transmitter box there is an antenna, a mains output, a male/female telephone plug as well as a green LED for the mains power supply. In the front door transmitter box there is a battery so that, in the event of a power cut of the mains supply, the system can continue to function for several hours. In the front door transmitter box there is also a transmitter which is activated by pressing on the pushbutton located on the outside of the box. As soon as it is activated this transmitter sends out a coded wave signal (programmable by a switch encoder—with a range and maximum frequency that comply with the law) to the receiver that triggers the vibrator-motor in the portable vibrating-receiver box as well as a yellow LED located on the outside of the portable vibrating-receiver box. On the outside of the front door transmitter box there is a pushbutton, an antenna, a mains output as well as a green LED for the mains power supply. The device, as defined by this invention, also consists of a portable vibrating-receiver box inside which there is a receiver (with its decoder and its switch coded with the switches from the different transmitters) that can receive a coded signal of a frequency and maximum range that comply with the law from anyone of the transmitters, a vibrator-motor, a battery to power the system, an antenna. On the outside of the portable vibrating-receiver box there are two golden contacts with which the receiver battery can be charged up, a watch, three LEDs that indicate from where the coded wave is sent (all three= presence detector transmitter, red=central transmitter, green=telephone plug transmitter, yellow=front door transmitter).

BRIEF DESCRIPTION OF THE DRAWINGS

The drawing in annex provides illustrations of the invention.

DETAILED DESCRIPTION OF THE PREFERRED EMBODIMENTS

Figure 2:
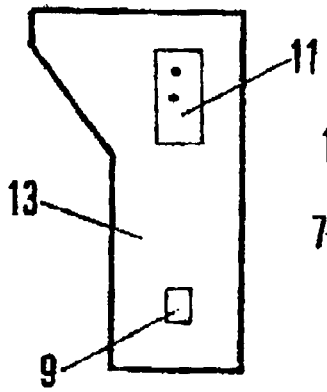
FIG. 2 shows the right hand side view of the invention's central transmitter box.
Figure 1:
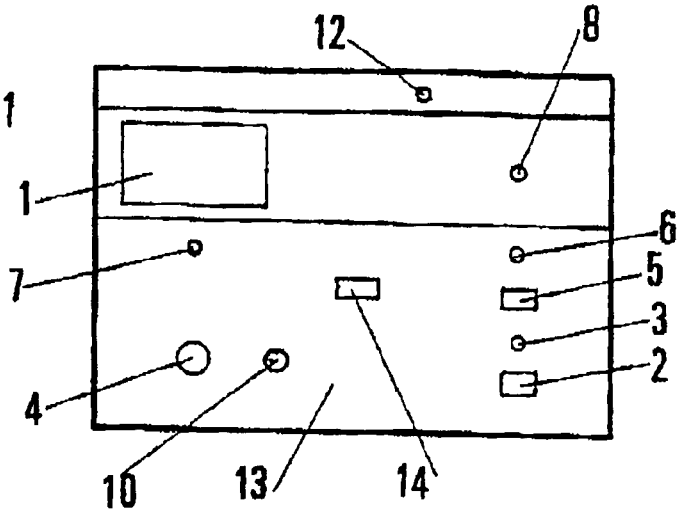
FIG. 1 shows the front view of the invention's central transmitter box.
Figure 3:
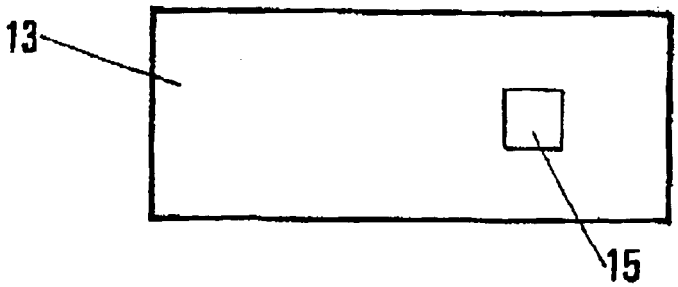
FIG. 3 shows the top view of the invention's central transmitter box.
Figure 4:
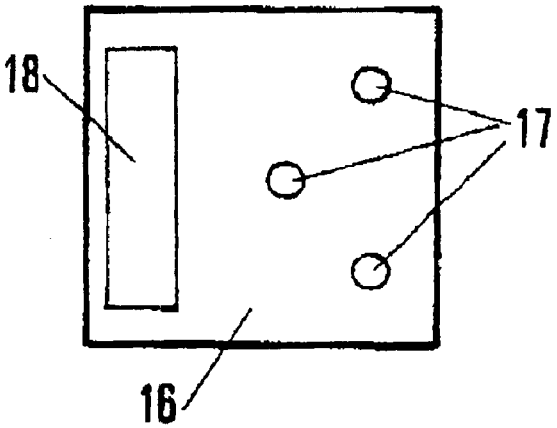
FIG. 4 shows the front view of the invention's portable vibrating-receiver box.
Figure 5:
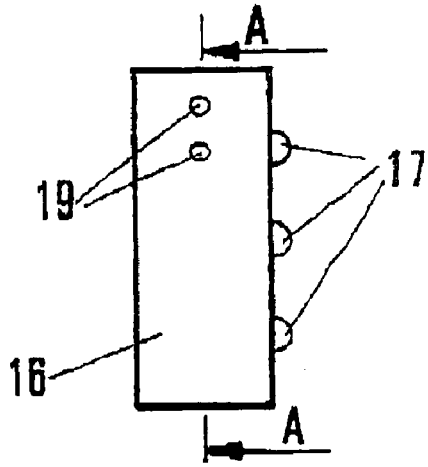
FIG. 5 shows the left-hand side view of the invention's portable vibrating-receiver box.
Figure 6:
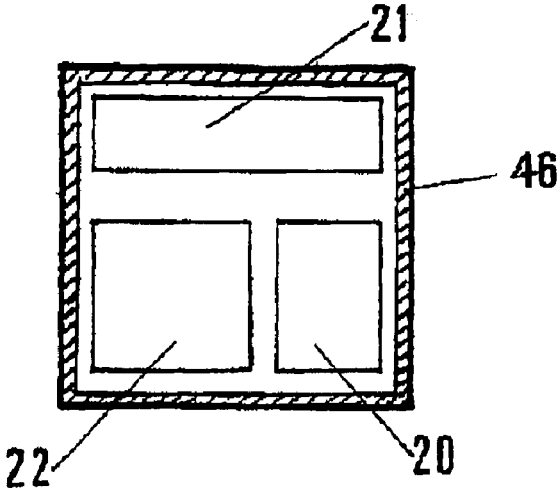
FIG. 6 shows a cross-section of the front view of the invention's portable vibrating-receiver box.
Figure 7:
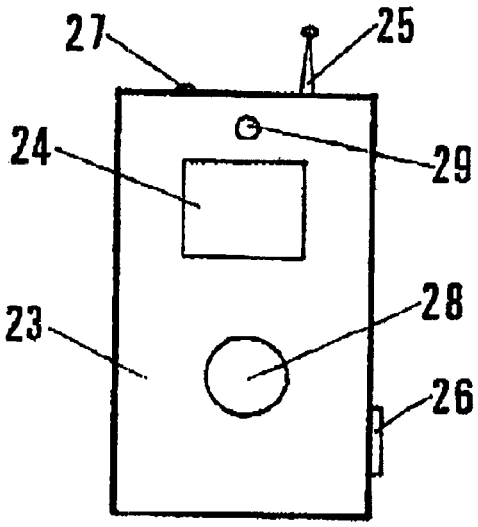
FIG. 7 shows the front view of the presence detector transmitter box.
Figure 8:
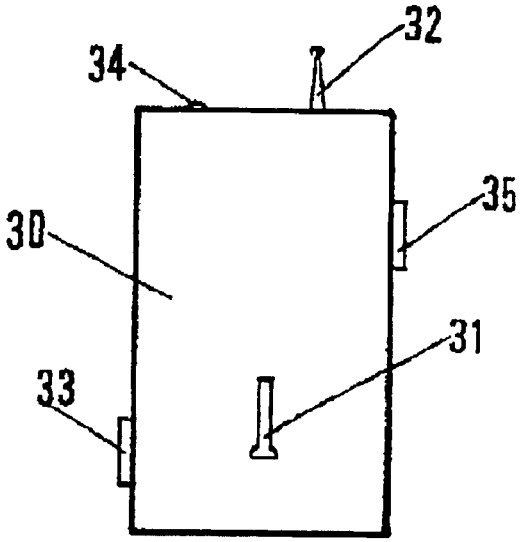
FIG. 8 shows the front view of the telephone plug transmitter box.
Figure 9:
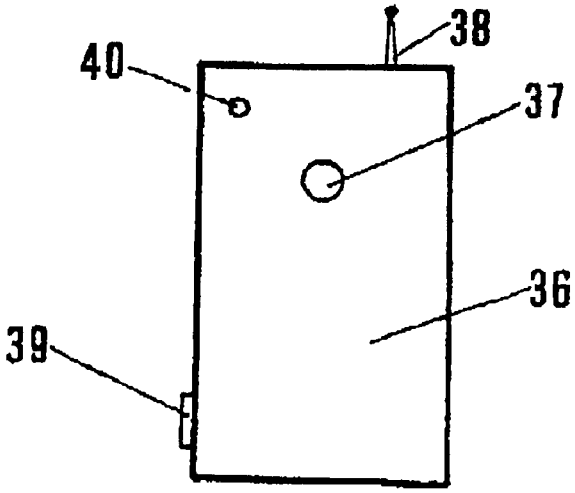
FIG. 9 shows the front view of the front door transmitter box.

Making reference to these drawings, the following can be seen on the front of the central transmitter box 13 represented in FIG. 1: a programmable clock (1), a pushbutton "alarm" (2) and its electroluminescent indicator LED (3), the microphone (4) for the voice/sound detection and its potentiometer (10) for adjustment of the microphone, a reversing switch (5) to switch the clock (1) and the voice/sound detector (4), a pushbutton (lit up =active) (14) to activate or deactivate the presence detector(s), a bicolor electroluminescent LED (6) that indicates the state of charge of the battery of the portable vibrating-receiver, a bicolor LED (7) (green=charged/red=discharged) to indicate the state of charge of the transmitter(s) battery for the presence detectors and central transmitter, a green mains LED (8), an antenna (12). On the side of the invention's central transmitter box represented in FIG. 2, there is a housing (11) with two golden and fool proofed contacts, which are used to charge up the battery of the vibrating-receiver, a "clearance" pushbutton (9) for the indicator LED (3) of the alarm pushbutton (2). On the back face of the Invention's central transmitter box represented in FIG. 3, is a mains output (15) with a mains cord and protection. Making reference to these drawings, the following can be seen on the outside of the invention's portable vibrating-receiver 16 represented in FIG. 4: a watch (18), three LEDs (17) of different colors that depend on from where the coded wave is sent from (central transmitter, presence detector, telephone plug, front door). Making reference to these drawings, the following can be seen on the outside of the invention's portable vibrating-receiver 16 represented in FIG. 5: three LEDS (17) of different colors that are activated depending on from where the coded wave is sent from, two golden contacts (19), which charge up the battery of the portable vibrating-receiver in the housing (11) located on the central transmitter. Making reference to these drawings, the following are to be found in the invention's portable vibrating-receiver box represented in FIG. 6: a receiver (20), a vibrator-motor (21), a battery (22) which is the power supply for the whole system. Making reference to these drawings, the following are to be found on the front of the invention's presence detector transmitter box 23 represented in FIG. 7: the presence detector system (24), an antenna (25), a mains output (26), a green LED (27) for the mains supply, a light (28) which lights up when a presence is detected, a red LED (29) that indicates the activation of the presence detector. Making reference to these drawings, the following are to be found on the front of the invention's telephone plug transmitter box 30 represented in FIG. 8: a male (31)/female (35) telephone plug, an antenna (32), a mains output (33), a green LED (34) for the mains supply. Making reference to these drawings, the following are to be found on the invention's front door transmitter box 36 represented in FIG. 9: a push button (37), an antenna (38), a mains output (39), a green LED (40) for the mains supply. Depending on how it is made: The central transmitter box represented in FIG. 1 has a flat part where, on the bottom right, there is an "alarm" push button (2) with, just above it, an electroluminescent LED diode (3), which shows that the order from the "alarm" push button has been sent out and correctly registered by the receiver in the portable vibrating-receiver box, above this is a reversing button (5) that activates either the clock (1), or the voice/sound detector (4) or simultaneously connects both of them, above this is the bicolor electroluminescent LED diode (6) that shows if the battery (22) of the portable vibrating-receiver is charged up; the microphone (4) of the voice/sound detector is found on bottom left with its potentiometer, on the right, for adjusting frequency and intensity; half-way up, in the middle, is a push button (lit up=active) (14) that activates or deactivates the presence detector(s), on the left there is a bicolor LED diode (7) that shows if the battery of the transmitters is charged up (central transmitter and presence detector transmitter). In the event of a power cut of the mains supply, this battery provides power for the system to operate for several hours. At the back of the flat part of the central transmitter box represented in FIG. 1, is a desk-shaped sloping surface with, on the left, a programmable clock (1), and on the right a green mains LED (8). On the back right of the central transmitter box, represented in FIG. 2, there is a housing (11) and two golden contacts and fool proofing conceived to receive the portable vibrating-receiver box represented in FIG. 4 and to charge up its battery (22)-the fool proofing system is employed to avoid any polarity inversion when charging the battery. On the front right of the central transmitter box, represented in FIG. 2 there is the "clearance" button (9) that deactivates the LED diode (3) that lights up when an order is sent out by the "alarm" push button (2). On the back of the central transmitter box, represented in FIG. 3, on the right hand side, there is a mains output (15) with a mains cord and protection. Depending on how it is made: On the portable vibrating-receiver box represented in FIG. 4 there is a watch (18), three LEDs (17) of different colors that depend on the where the signal is sent out from. On the vibrating-receiver box represented in FIG. 5 there are two contacts (19) to charge up the battery (22) of the portable vibrating receiver and three LEDs (17) of different colors that depend on the where the signal is sent out from. In the portable vibrating-receiver box represented in FIG. 6 there is a receiver (20) with its decoder and its switch, a vibrator-motor (21), a battery (22) that supplies power to the box. Depending on how it is made: On the presence detector transmitter box represented in FIG. 7 there is presence detection system (24). On top of this there is an antenna (25), a green LED (27) for the mains supply. On the right hand side is a mains output (26), a light (28) that is activated by the presence detector when a presence is detected, a LED diode (29) that shows when the presence detection system is in operation. Depending on how it is made: On the telephone plug transmitter box represented in FIG. 8 there is a male (31) and female (35) telephone plug. On top this there is an antenna (32), a green LED (34) for the mains supply. On the right hand side there is a mains output (33). Depending on how it is made: On the front door transmitter box represented in FIG. 9 there is a push button (37), a green LED (40) for the mains supply. On top there is an antenna (38) and on the left side a mains output (39). To give a nonrestrictive example, the central transmitter box in ABS will be in the shape of a desk with the following approximate dimensions: a width of 175 mm, a length of 125 mm and a height of 70 mm To give a nonrestrictive example, the portable vibrating-receiver box in ABS will be flat and as small as possible. It will have the following approximate dimensions: 35 mm×35 mm and 12 mm thick . To give a nonrestrictive example; the portable vibrating-receiver box will be either mounted on a bracelet or an integral part of a bracelet to be worn on the wrist, arm or ankle. It will also be available in the form of a box with a fastener that can be fixed to a trouser belt, shirt, overall or jacket pocket. To give a nonrestrictive example, the boxes in ABS of the presence detector transmitter (23), telephone plug transmitter (30) and front door transmitter (36), will have the following approximate dimensions: length—100 mm, width—40 mm and depth—30 mm. To give a nonrestrictive example, the front door transmitter (36) will be adapted to all intercommunication systems (audio or video). To give a nonrestrictive example, the quality and range of the transmission of coded waves from the transmitters (13-23-30-36) to the receiver (20) in the portable vibrating-receiver will, depending on the area to be, covered, by improved by the addition of one or several relay antennae 46. To give a nonrestrictive example, there will be a LED that determines the reception limits in the portable vibrating-receiver box.

Device with portable vibrating-receiver (16) (worn—as designed for this system—on the wrist, arm, ankle, or attached to the belt or jacket or shirt pocket), and the transmitters (13-23-30-36) is characterized by its multiple functions: voice/sound detection, (4), programmable clock (1), "alarm" push button (2), presence detection (24), telephone plug (31/35), front door (37), which make it possible for this device to be used and/or help all persons and in particular the elderly, handicapped, sick, deaf or hearing impaired and blind and also be used to survey babies and generally to warn, whenever needed, or in the event of an urgency or danger, all persons equipped with a portable vibrating-receiver (16).

What is claimed is:

1. A transmitter/vibrating receiver system that discreetly warns one or several people, at a distance, said system comprising:

plural transmitters that include (a) a central transmitter box with at least a first LED, (b) at least one presence detector transmitter box with a presence detector, a receiver, a LED, and a light, (c) a telephone plug transmitter box responsive to a telephone call to send a signal and (d) a front door transmitter box responsive to action at a front door to send a signal; and at least one portable vibrating-receiver box that receives a respective signal from at least one of said plural transmitters, said at least one portable vibrating-receiver box having a receiver, a rechargeable battery and at least two LEDs, a respective one of said at least two LEDs denoting which one of said plural transmitters is sending a signal, said central transmitter box having an ALARM push button that manually triggers a first coded signal sent by said central transmitter box to the receiver of the portable vibrating-receiver box, said coded signal turns ON a vibrator-motor of the portable vibrating-receiver box and triggers a corresponding one of said at least two LEDs of the portable vibrating-receiver box, said first LED of said central transmitter box indicating that an order from the ALARM push button was sent out correctly by the central transmitter box and registered by the receiver of the portable vibrating-receiver, wherein said central transmitter box further comprises a housing, said portable vibrating-receiver box being releasably connectable by two contacts to said housing to charge the battery of the portable vibrating-receiver box, wherein said central transmitter box further comprises a push button that activates or deactivates the presence detector at a distance with a second coded signal sent by the central transmitter box to the receiver of the presence detector transmitter box, the LED of the presence detector transmitter box lighting-up when the presence detector is in operation, and wherein whenever a presence is detected, the presence detector lights-up the light of the presence detector transmitter box and activates the presence detector transmitter box to send a third coded signal to the receiver of the portable vibrating-receiver box, said third coded signal turns ON the vibrator-motor of the portable vibrating-receiver box and triggers a respective LED of the portable vibrating-receiver box.

2. The system according to claim 1, wherein said central transmitter box further comprises a programmable clock with which several cycles per day can be programmed over an eight day period to trigger said first coded signal from said central transmitter box to the receiver of the portable vibrating-receiver box and activate the vibrator-motor of the portable vibrating-receiver box, and wherein said central transmitter box further comprises a microphone with a voice/sound detector that detects according to a preset frequency and intensity, voices, crying and noises and that triggers upon detection, said first coded signal from the central transmitter to the receiver of the portable vibrating-receiver box and activates the vibrator-motor of the portable vibrating-receiver box.

3. The system according to claim 2, wherein said central transmitter box further comprises a reversing switch push button that connects or disconnects the clock and the voice/sound detector simultaneously or switches the triggering from the clock or the triggering from the voice/sound detector, and wherein the push button of the central transmitter box that activates or deactivates the presence detector has a light which lights-on when activated.

4. The system according to claim 1, wherein said central transmitter box further comprises a bicolor LED diode that indicates a state of charge of the rechargeable battery of the portable vibrating-receiver box and a mains power indication LED.

5. The system according to claim 1, wherein said central transmitter box further comprises a bicolor LED diode that indicates the charge of the rechargeable battery of the central transmitter box and of the presence detector transmitter box.

6. The system according to claim 1, wherein said central transmitter box further comprises a CLEARANCE push-button that deactivates the first LED diode of the central transmitter box.

7. The system according to claim 1, wherein said central transmitter box further comprises a mains output with a mains cord and protection; and wherein said housing further comprises foolproofing to avoid polarity inversion when charging said rechargeable battery of said portable vibrating-receiver box.

8. The system according to claim 7, wherein said portable vibrating-receiver box further comprises a decoder with a switch and a watch and has two golden contacts that are used to charge-up the rechargeable battery of said portable vibrating-receiver.

9. The system according to claim 1, wherein each of said central transmitter box, said presence detector transmitter box, said telephone plug transmitter box and said front door transmitter box have means for sending a coded wave to the receiver of the portable vibrating-receiver box that triggers the vibrator-motor of the portable vibrating-receiver box and one of three different colored LED diodes depending on which of said plural transmitters has sent the coded wave, or activates all three LEDs if the coded wave has been sent by the presence detector transmitter box.

10. The system according to claim 1, wherein said portable vibrating-receiver box is to be worn on a wrist, an arm, an ankle, or is to be attached to a belt, a jacket pocket or a shirt pocket, of a person.

11. The system according to claim 3, wherein said portable vibrating-receiver box is to be worn on a wrist, an arm, an ankle, or is to be attached to a belt, a jacket pocket or a shirt pocket, of a person.

12. The system according to claim 6, wherein said portable vibrating-receiver box is to be worn on a wrist, an arm, an ankle, or is to be attached to a belt, a jacket pocket or a shirt pocket, of a person.

13. The system according to claim 9, wherein said portable vibrating-receiver box is to be worn on a wrist, an arm, an ankle, or is to be attached to a belt, a jacket pocket or a shirt pocket, of a person.

14. A transmitter/vibrating receiver system for discreetly warning a user of the receiver, said system comprising:

plural separate transmitters that include (a) a central transmitter, (b) at least one presence detector transmitter, (c) a telephone plug transmitter responsive to a telephone call to send a signal and (d) a front door transmitter responsive to action at a front door to send a signal; and a portable vibrating-receiver device that receives a respective signal from one of said plural transmitters, said at least one portable vibrating-receiver device having a receiver, a rechargeable battery and plural LEDs, a respective one of said plural LEDs denoting which one of said plural transmitters is sending a signal, said central transmitter having an ALARM push button that manually triggers a first coded signal sent by the central transmitter to the receiver of the portable vibrating-receiver device, said coded signal turns ON a vibrator-motor of the portable vibrating-receiver and triggers a corresponding one of said plural LEDs of the portable vibrating-receiver device, wherein said central transmitter further comprises a housing, said portable vibrating-receiver being releasably connectable by two contacts to said housing to charge the battery of the portable vibrating-receiver box, and wherein whenever a presence is detected by the presence detector transmitter, said presence detector transmitter sends a second coded signal to the receiver of the portable vibrating-receiver device, said second coded signal turns ON the vibrator-motor of the portable vibrating-receiver and a respective LED of the portable vibrating-receiver device.

* * * * *